US007094103B2

(12) United States Patent
Lai

(10) Patent No.: US 7,094,103 B2
(45) Date of Patent: Aug. 22, 2006

(54) CABLE CONNECTOR ASSEMBLY HAVING IMPROVED SHIELD MEMBERS

(75) Inventor: Chin Te Lai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/873,867

(22) Filed: Jun. 21, 2004

(65) Prior Publication Data

US 2004/0259421 A1 Dec. 23, 2004

(30) Foreign Application Priority Data

Jun. 20, 2003 (TW) ..... 92211305 U

(51) Int. Cl.
*H01R 9/03* (2006.01)

(52) U.S. Cl. ..... 439/610

(58) Field of Classification Search ..... 439/610, 439/608, 752, 722, 736, 701, 733.1, 101, 439/108

See application file for complete search history.

(56) References Cited

U.S. PATENT DOCUMENTS 5,409,400 A * 4/1995 Davis ..... 439/610
6,146,205 A * 11/2000 Lai ..... 439/610
6,299,487 B1 10/2001 Lopata et al.
6,659,804 B1 * 12/2003 Nishio et al. ..... 439/733.1

* cited by examiner

*Primary Examiner*—Tho D. Ta
*Assistant Examiner*—Felix O. Figueroa
(74) *Attorney, Agent, or Firm*—Wei Te Chung

(57) ABSTRACT

A cable connector assembly (1) includes an insulative housing (21), a number of contacts (251) received in the insulative housing, a cable (3) including a number of wires (30) each including a conductive core (32) electrically connecting with a corresponding contact and a shielding braid (33) surrounding the conductive core, at least a shield members (24) mechanically and electrically connecting with the shielding braid of the cable, and a shell (20) retained to the insulative housing. At least a shield member includes a leg portion electrically connecting with at least a contact.

3 Claims, 8 Drawing Sheets

CABLE CONNECTOR ASSEMBLY HAVING IMPROVED SHIELD MEMBERS

BACKGROUND OF THE INVENTION

1. Field of the Invention

The present invention generally relates to a cable connector assembly, and particularly to a cable connector assembly having improved shield members.

2. Description of Related Art

Cable connector assemblies are commonly used to connect peripheral devices with a computer for performing data transmission therebetween. When the cable connector assemblies are used in high speed data transmission applications, the amount of electromagnetic (EMI) or radio frequency interference (RFI) increases. The EMI or RFI problem may be reduced by shielding. A conventional cable connector assembly as disclosed in U.S. Pat. No. 6,299,487 includes a plug connector and a cable connecting with the plug connector. The plug connector includes an insulative body portion, a shell partially insert-molded in the insulative body portion, and an internal terminal assembly received in the insulative body portion. The internal terminal assembly has a plurality of terminals connecting with distal ends of the cable.

However, the distal ends of the signal conductors of the cable are partially exposed outside, so the cross-talk occurs between the exposed signal conductors, thereby adversely affecting performance of the signal transmission. In addition, the shell of the plug connector has an integral and elongated hollow form with a front end and a rear end that are interconnected by a body portion. Significantly, it is difficult to completely insert the internal terminal assembly into the shell without inadvertently deflecting contact portions of the conductive terminals. In addition, since the internal terminal assembly is fully received in the shell, the cable should be soldered with the conductive terminals before the internal terminal assembly is inserted into the shell. Accordingly, a reliable connection between the cable and the conductive terminals is adversely affected during the insertion of the internal terminal assembly into the shell.

Hence, a cable connector assembly having improved shield members is desired to solve above-mentioned problems.

SUMMARY OF THE INVENTION

An object of the present invention is to provide a cable connector assembly having improved shield members for ensuring good electrical performance thereof.

To achieve the above object, a cable connector assembly in accordance with the present invention comprises an insulative housing, a plurality of contacts received in the insulative housing, a cable comprising a plurality of wires each comprising a conductive core electrically connecting with a corresponding contact and a shielding braid surrounding the conductive core, a shield member electrically connecting with the shielding braids of the cable, and a shell retained to the insulative housing. The conductive core of each wire is exposed to outside at one end thereof. The shield member comprises a pair of shielding portions surrounding the exposed conductive cores of the cable. The shell surrounds the contacts and the shield member.

Other objects, advantages and novel features of the invention will become more apparent from the following detailed description when taken in conjunction with the accompanying drawings.

DETAILED DESCRIPTION OF THE INVENTION

Figure 1:
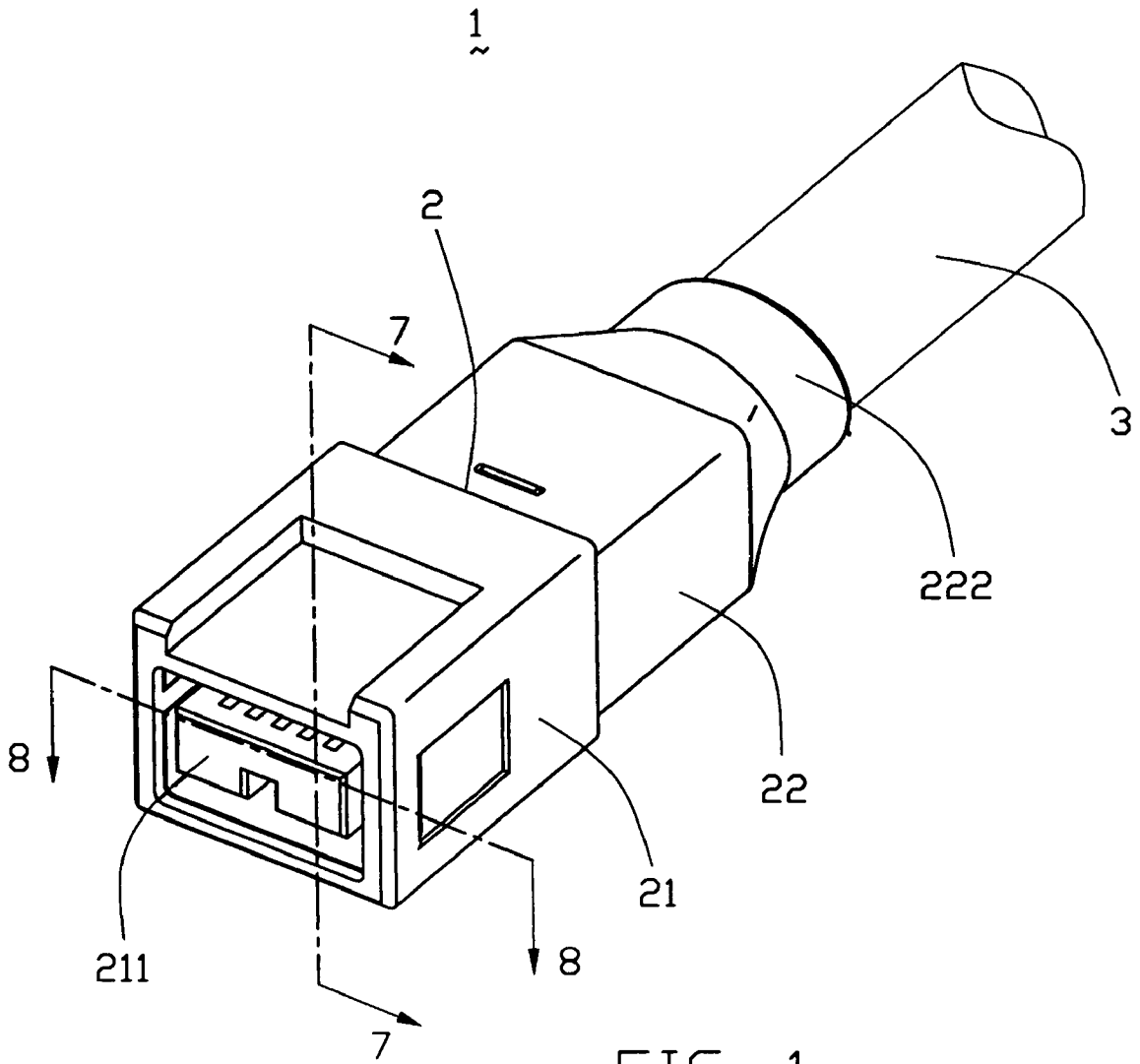
FIG. 1 is an assembled perspective view of a cable connector assembly in accordance with the present invention.
Figure 2:
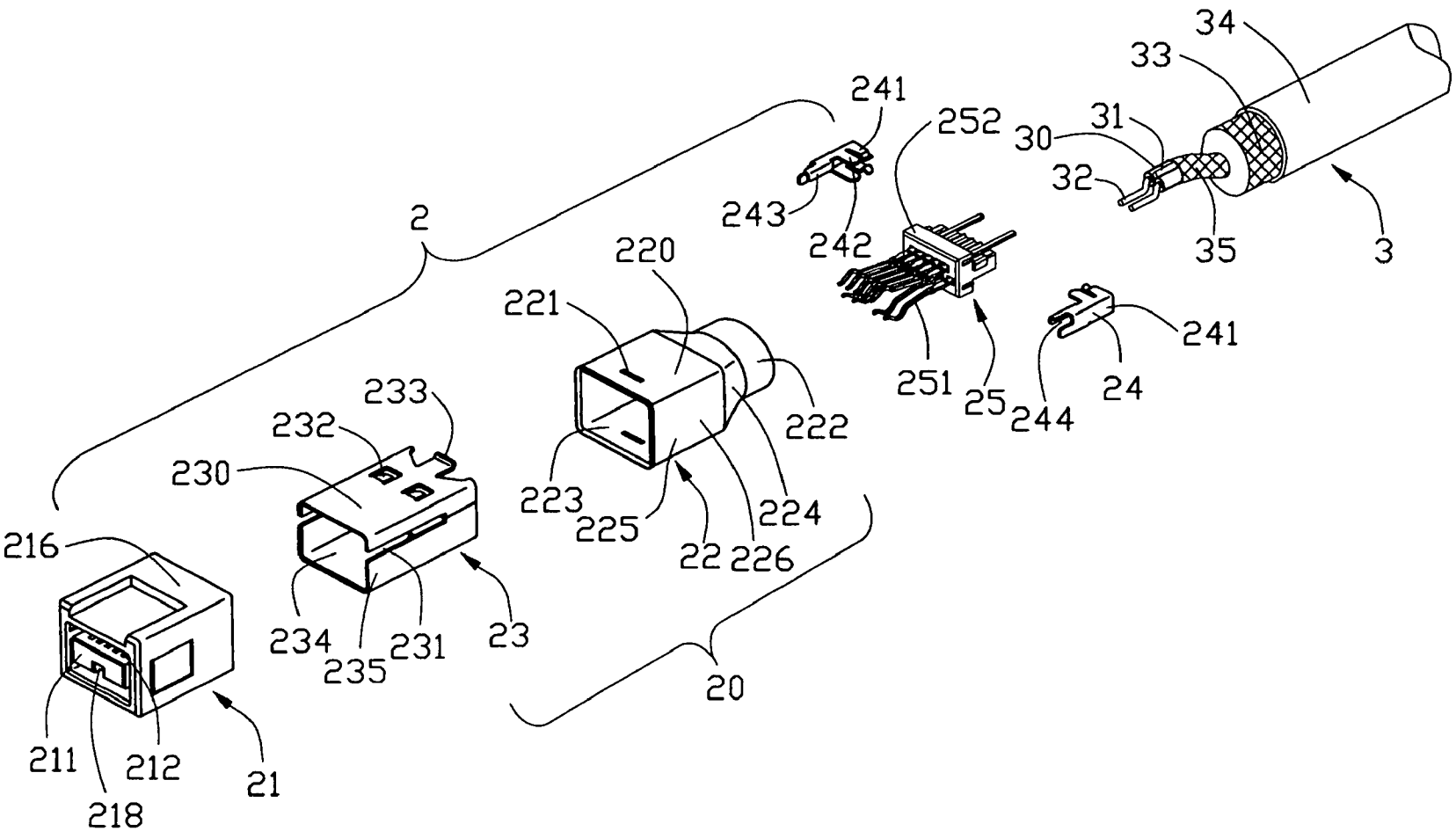
FIG. 2 is an exploded perspective view of the cable connector assembly of FIG. 1.

Referring to FIGS. 1 and 2, a cable connector assembly 1 in accordance with the present invention comprises an electrical connector 2 and a cable 3 electrically connecting with the electrical connector 2. The electrical connector 2 comprises an insulative housing 21, a contact module 25, a pair of shield members 24, and a shell 20.

Figure 7:
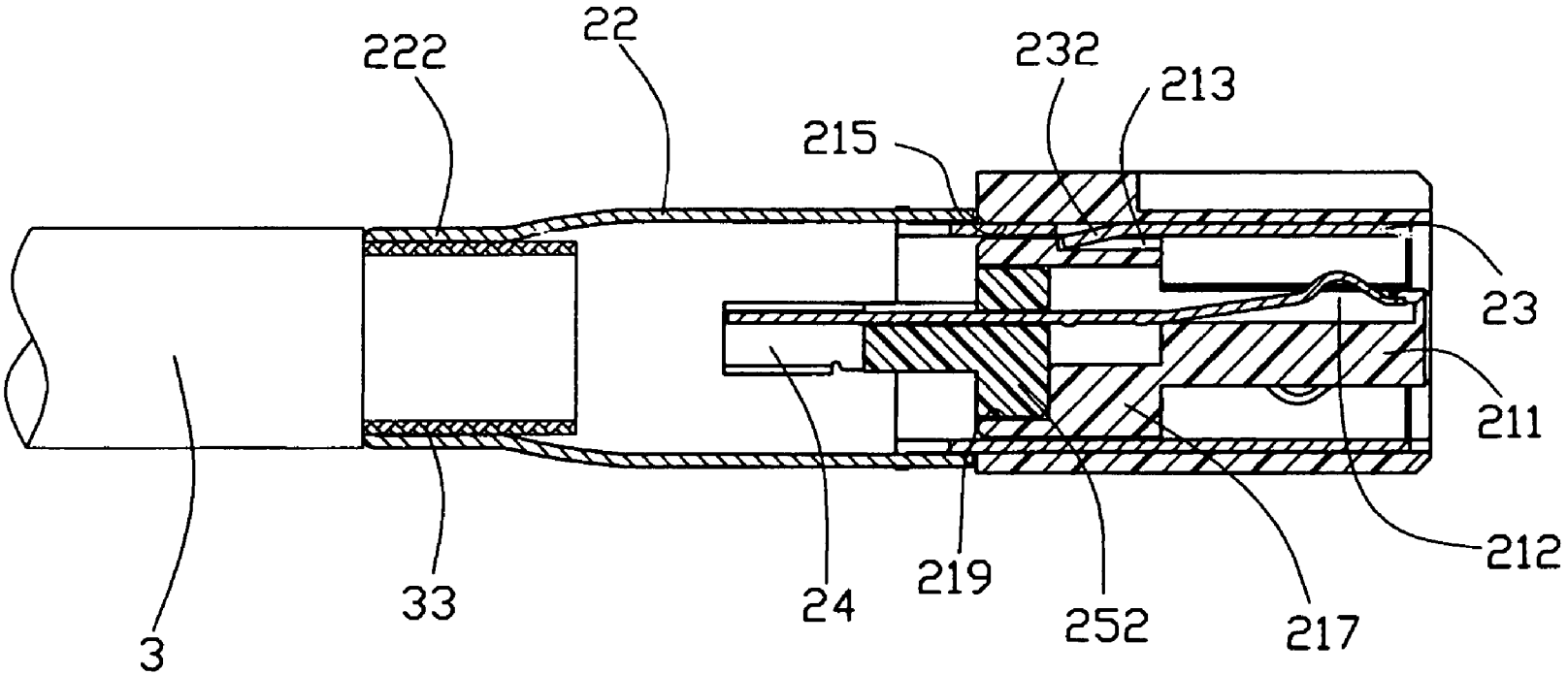
FIG. 7 is a cross-sectional view taken along line 7—7 of FIG. 1.
Figure 8:
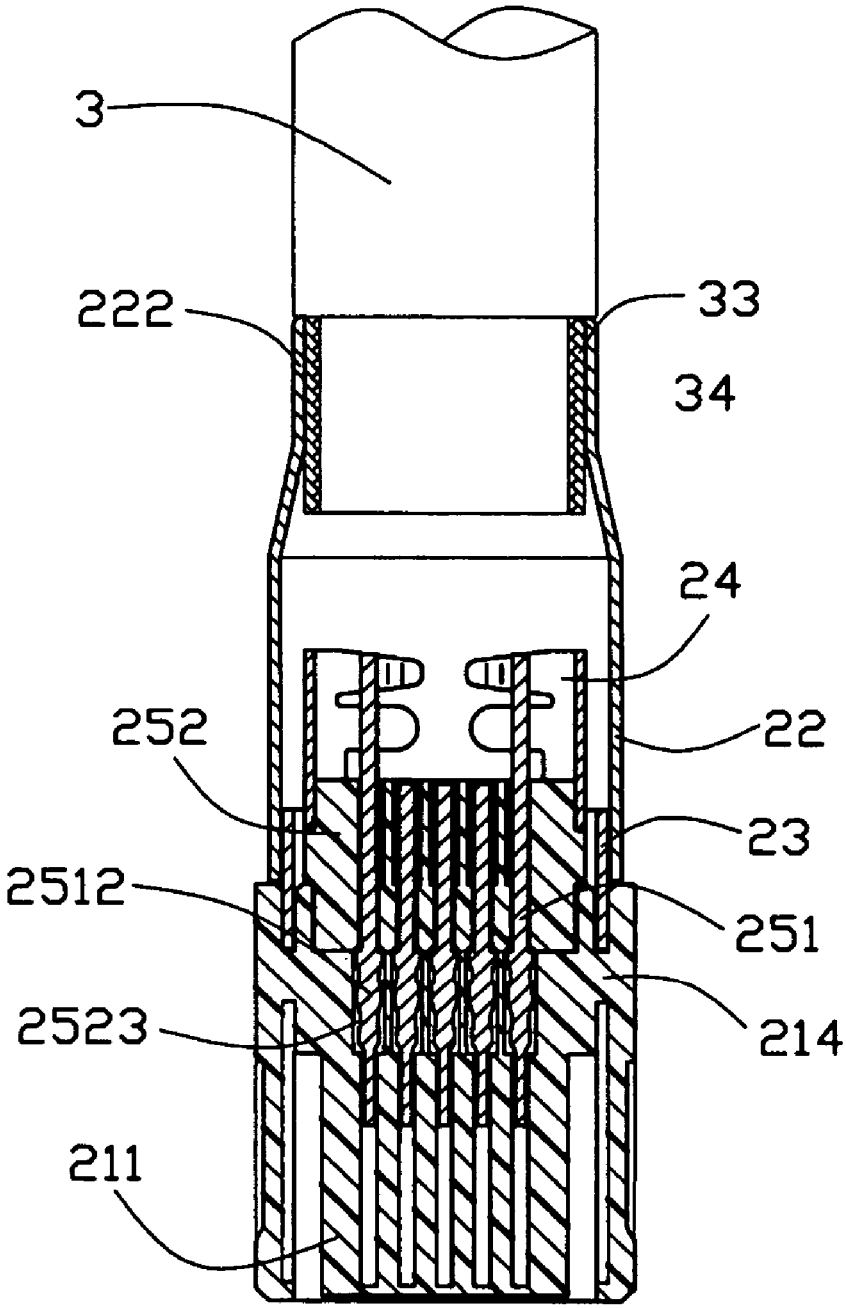
FIG. 8 is a cross-sectional view taken along line 8—8 of FIG. 1.

Referring to FIGS. 2, 7 and 8, the insulative housing 21 comprises a base 217, a casing 216 surrounding the base 217 and connecting with the base 217 by a pair of ribs 214 formed on opposite side faces of the base 217, and a mating plate 211 extends forwardly from a front face of the base 217. The casing 216 and the base 217 define a receiving slot 215 therebetween. The base 217 defines a cavity 219 in a rear face thereof for receiving the contact module 25 and a pair of recesses 213 in a top face thereof. The mating plate 211 defines a plurality of passageways 212 in opposite upper and lower faces thereof. The passageways 212 extend rearwardly throughout the base 217 and communicate with the cavity 219 in the rear face of the base 217. In addition, the mating plate 211 defines a groove 218 in a middle of a lower face thereof for receiving a corresponding portion of a complementary connector (not shown) to ensure a correct connection.

Figure 4:
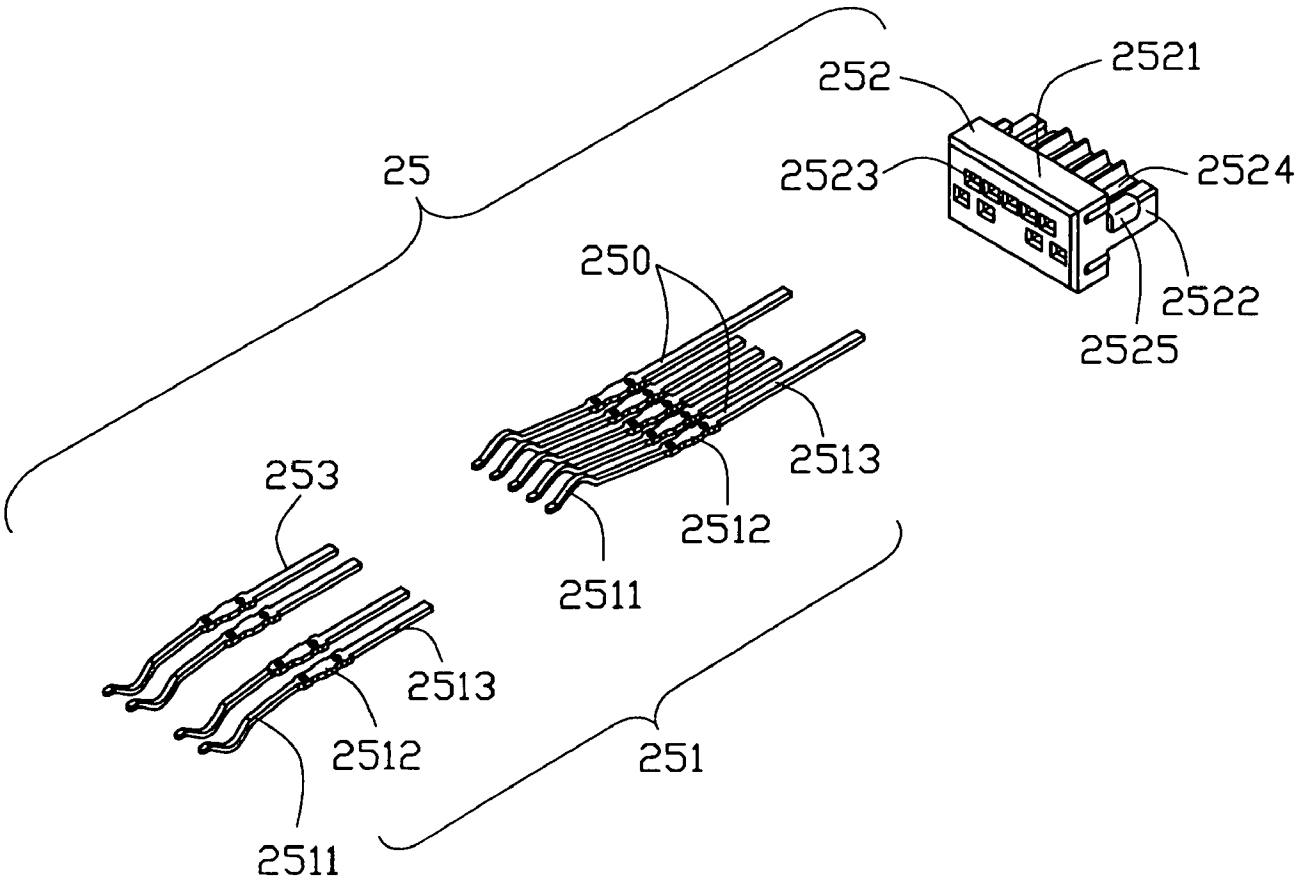
FIG. 4 is an exploded perspective view of a contact module of the cable connector of FIG. 1.

Referring to FIGS. 2 and 4, the contact module 25 comprises a contact holder 252 and a plurality of contacts 251 retained in the contact holder 252. The contact holder 252 comprises a main body 2521 and a tongue 2522 extending rearwardly from a rear face of the main body 2521. The tongue 2522 defines a plurality of slots 2524 in upper and lower faces thereof and extending throughout the main body 2521 to thereby forming a corresponding number of holes 2523 in the main body 2521. The tongue 2522 is formed with a pair of projections 2525 on opposite side faces thereof and adjacent to the upper face thereof. The contacts 251 comprise ground contacts 250 and signal contacts 253. Each contact 251 comprises a retention portion 2512, a contact portion 2511 extending forwardly from the retention portion 2512, and a tail portion 2513 extending rearwardly from the retention portion 2512.

Figure 3:
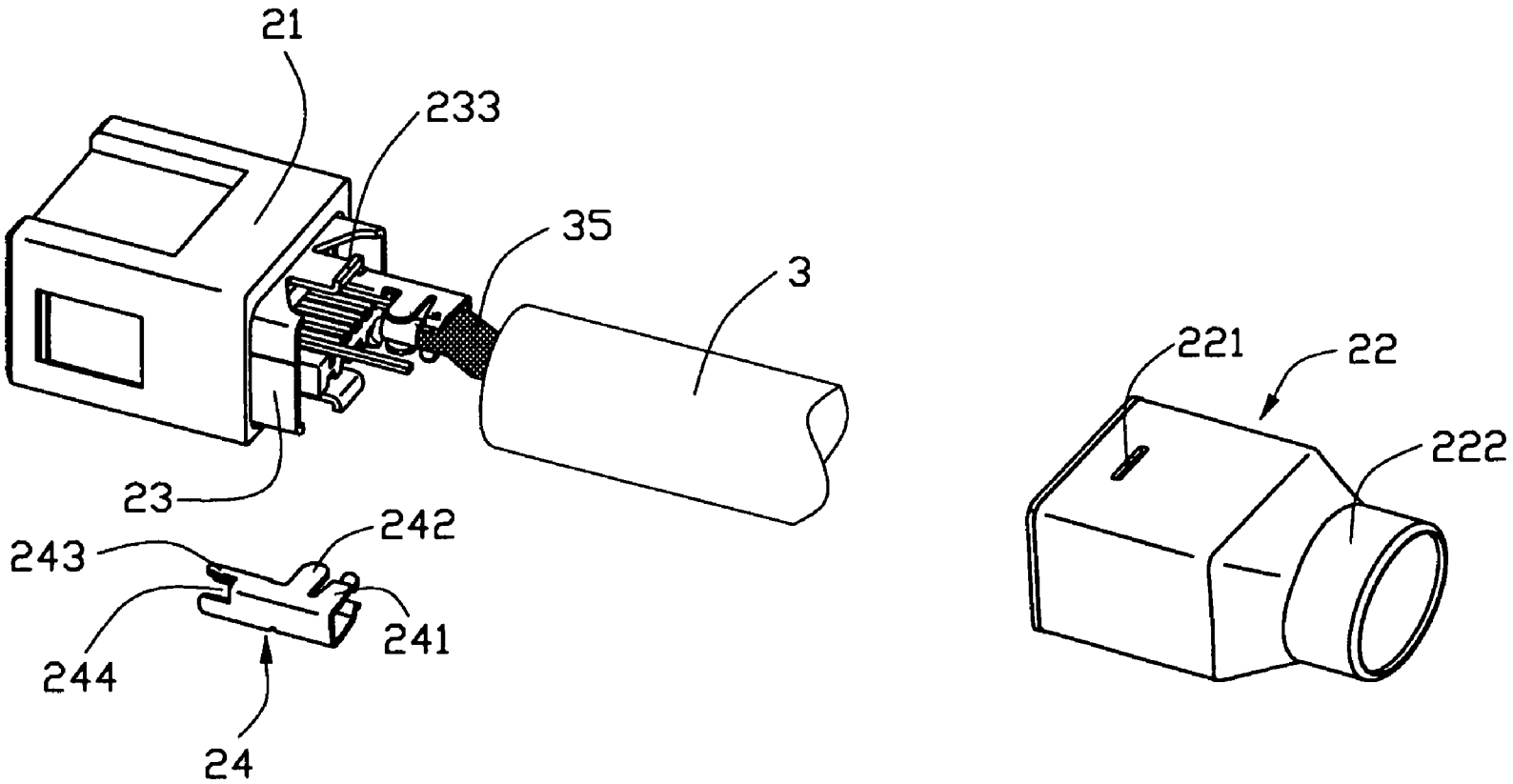
FIG. 3 is a partially exploded perspective view of the cable connector assembly of FIG. 1.
Figure 5:
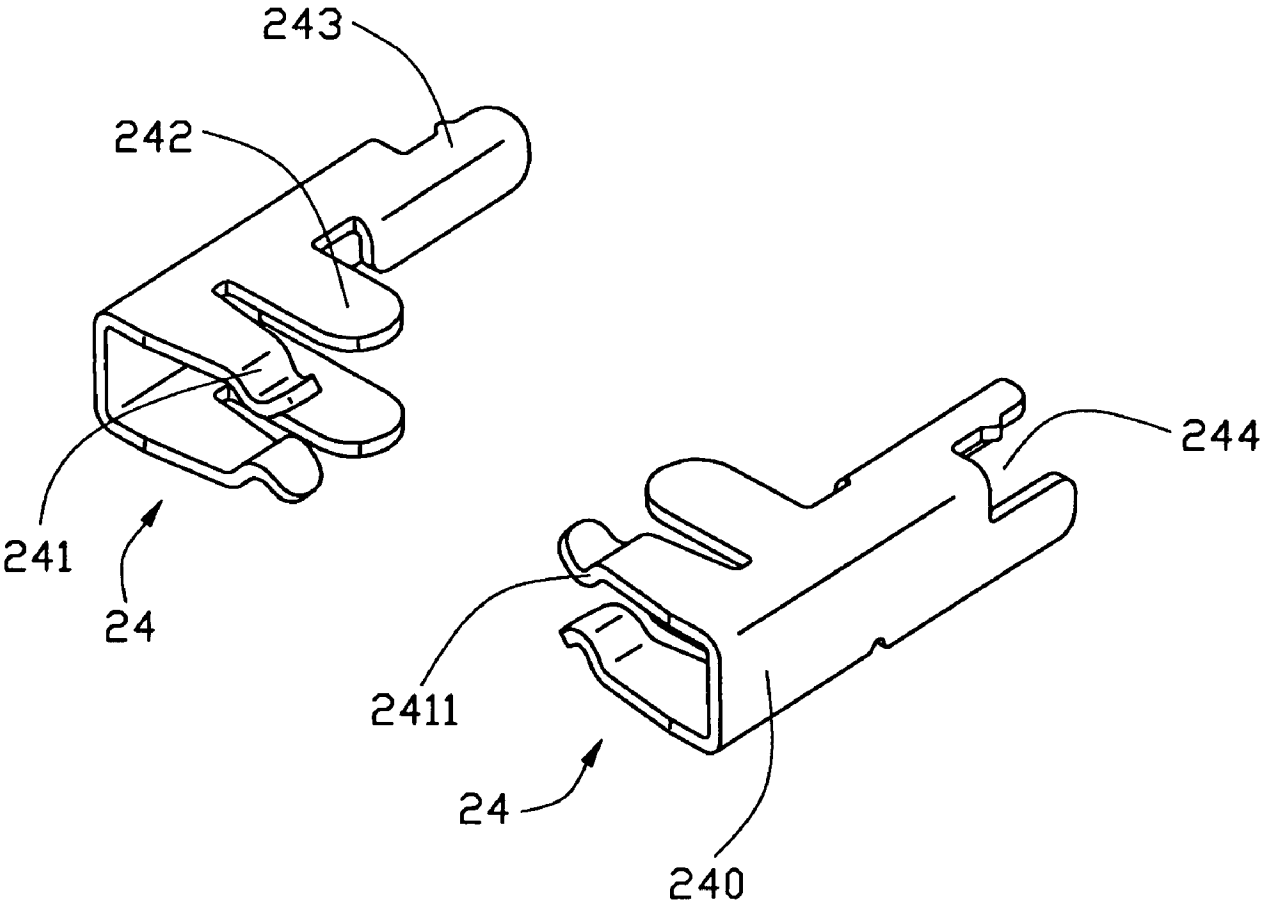
FIG. 5 is a perspective view of shield members of the cable connector assembly of FIG. 1.
Figure 6:
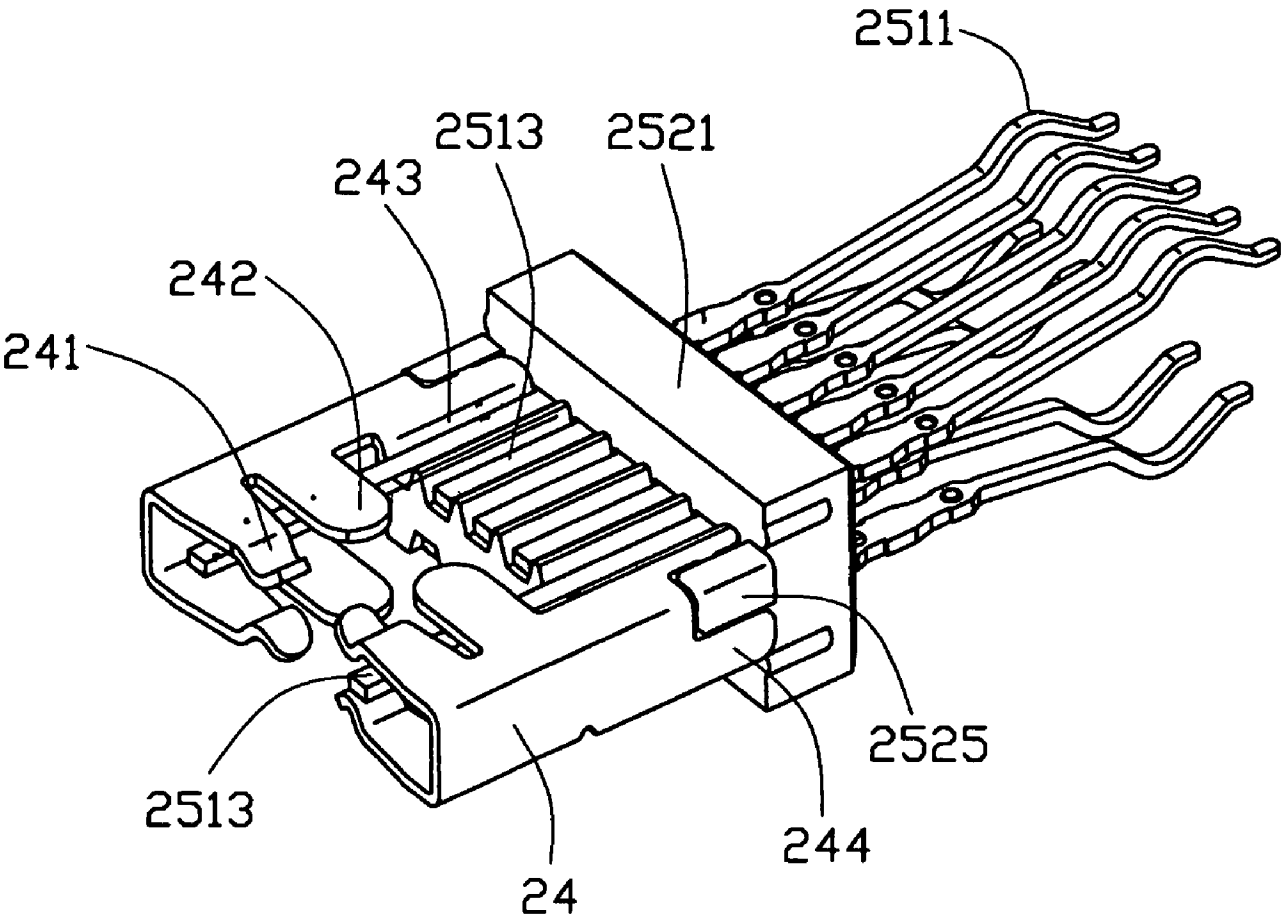
FIG. 6 is an assembled perspective view of the contact module of FIG. 4 with the shield members of FIG. 5 assembled thereto.

Referring to FIGS. 3, 5 and 6, each shield member 24 is formed from a metal sheet and comprises a body portion 240, a pair of clamping arms 241 extending perpendicularly and inwardly from an upper and a lower edges of the body portion 240 and adjacent a rear end of the body portion 240, a pair of shielding portions 242 extending perpendicularly and inwardly from the upper and the lower edges of a middle portion of the body portion 240, and a L-shaped leg portion 243 extending forwardly from adjacent a front end of the body portion 240. The leg portion 243 and the body portion 240 together define a cutout 244 therebetween. The pair of clamping arms 241 is formed with a pair of clamping portions 2411 at free ends thereof.

Referring to FIG. 2 again, the shell 20 comprises a front shell 23 and a rear shell 22. The front shell 23 comprises a front top wall 230, a front lower wall 234 opposite to the front top wall 230, and two opposite front side walls 235 connecting with the front top wall 230 and the front lower wall 234. A pair of inwardly and rearwardly extending tabs 232 are formed on the front top wall 230. A pair of latches 233 extend rearwardly from rear ends of the front top and the front lower walls 230, 234. The two front side walls 235 define a pair of slits 231 adjacent front ends thereof. The rear shell 22 comprises a rectangular main portion 226 having a rear top wall 220, a rear lower wall 223 opposite to the rear top wall 220, and two opposite rear side walls 225 connecting with the rear top and the rear lower walls 220, 223, a transitional portion 224 extending rearwardly from the main portion 226, and a cylindrical portion 222 extending rearwardly from the transitional portion 224. The rear top and the rear lower walls 220, 223 define a pair of openings 221 therein.

The cable 3 comprises a plurality of wires 30 (only one being shown), each including a pair of signal conductive cores 32 and a ground conductive core 31, a shielding braid 35 surrounding the signal and the ground conductive cores 32, 31, a shielding 33 surrounding the shielding braid 35, and a cover 34 enclosing the shielding 35. The signal and the ground conductive cores 32, 31 are exposed to outside at ends thereof.

Referring to FIGS. 1–3 and 7–8, in assembly, the contacts 251 are retained to the contact holder 252 with the retention portions 2512 interferentially fitted in the holes 2523 and with the tail portions 2513 received in the slots 2524. The shield members 24 are mounted on the opposite sides of the tongue 2522 with the projections 2525 received in the cutouts 244. The leg portions 243 of the shield members 24 extend into the corresponding slots 2524 in which the tail portions 2513 of the ground contacts 250 are received. The leg portions 243 of the shield members 24 can be electively soldered with the tail portions 2513 of the ground contacts 250. In this embodiment of the present invention, the leg portions 243 of the shield members 24 are not soldered with the tail portions 2513 of the ground contacts 250. The contact module 25 with the shield members 24 is then inserted into the cavity 219 of the base 217 with the contact portions 2511 received in the passageways 211 of the mating plate 211 and the tongue 2522 rearwardly exposed outside of the insulative housing 21.

The front shell 23 is inserted into the receiving slot 215 between the casing 216 and the base 217 with the ribs 214 received in the slits 231 of the front shell 23. The tabs 232 abut against rear end walls (not labeled) of the recesses 213 in the top face of the base 217. A rear end of the front shell 23 and the latches 233 extend rearwardly beyond the rear face of the insulative housing 21. The rear shell 22 moveably encloses the cable 3. The clamping portions 2411 of the shield members 24 clamp the shielding braids 35 of the cable 3. The tail portions 2513 of the ground contacts 250 and the clamping arms 241 of the shield members 24 are then soldered with the shielding braids 35. The shielding portions 242 of the shield member 24 surround and shield the exposed signal conductive cores 32. The signal conductive cores 32 are soldered with the tail portions 2513 of the signal contacts 253 in ways known to persons skilled in the pertinent art. The rear shell 22 is pushed forwardly to abut against the rear face of the insulative housing 21. Front ends of the rear top wall 220, the rear lower wall 223, and the rear side walls 225 of the rear shell 22 surround the rear ends of the front top wall 230, the front lower wall 234, and the front side walls 235 of the front shell 23 for ensuring an electrical connection between the front shell 23 and the rear shell 22. The latches 233 of the front shell 23 are received in the openings 221 of the rear shell 22. The cylindrical portion 222 of the rear shell 22 encloses the shielding 33 of the cable 3.

The exposed signal conductive cores 32 are shielded by the shielding portions 242 of the shield members 24 to prevent the cross-talk between the conductive cores 32. In addition, since the shell 20 is a two-piece configuration comprising a front shell 23 and a rear shell 22, the contact module 5 can be conveniently assembled to the insulative housing 21. The wires 30 of the cable 3 are soldered with the contacts 251 of the contact module 5 after the contact module 5 is received in the cavity 219 of the insulative housing 21, thereby ensuring a reliable electrical connection between the contact module 5 and the cable 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing;

a plurality of contacts received in the insulative housing;

a cable comprising a plurality of wires each comprising a conductive core electrically connecting with a corresponding contact and a shielding braid surrounding the conductive core, the conductive core being exposed to outside at one end thereof;

at least a shield member mechanically and electrically connecting with the shielding braid of the cable, the at least a shield member comprising a leg portion for electrically connecting with at least a contact; and a shell retained to the insulative housing and surrounding the contacts and the shield member; wherein the insulative housing comprises a base, a casing surrounding the base, and a mating plate extending forwardly from a front face of the base; wherein the base defines a cavity in a rear face thereof, and wherein the mating plate defines a plurality of passageways in opposite upper and lower faces thereof and communicating with the cavity;

further comprising a contact holder comprising a main body received in the cavity of the insulative housing and a tongue extending rearwardly from a rear face of the main body;

wherein the main body defines a plurality of holes, wherein the tongue defines a plurality of slots communicating with the holes of the main body, and wherein each contact comprises a retention portion interferentially fitted in a corresponding hole of the main body of the contact holder, a contact portion extending forwardly from the retention portion and received in a corresponding passageway of the base of the insulative housing, and a tail portion extending rearwardly from the retention portion and received in a corresponding slot of the tongue of the contact holder;

wherein the shield member is mounted on a side of the tongue of the contact holder;

wherein each shield member comprises a body portion and a pair of clamping arms extending from the body portion and clamping the shielding braid of the cable;

further comprising a second shield member mounted on a second side of the tongue of the contact holder.

2. A cable connector assembly comprising:

an insulative housing;

a plurality of contacts received in the insulative housing;

a cable comprising a plurality of wires each comprising a conductive core electrically connecting with a corresponding contact and a shielding braid surrounding the conductive core, the conductive core being exposed to outside at one end thereof;

at least a shield member mechanically and electrically connecting with the shielding braid of the cable, the at least a shield member comprising a leg portion for electrically connecting with at least a contact; and a shell retained to the insulative housing and surrounding the contacts and the shield member; wherein the insulative housing comprises a base, a casing surrounding the base, and a mating plate extending forwardly from a front face of the base; wherein the shell comprises a front shell disposed between the base and the casing of the insulative housing; wherein wherein the cable comprises a shielding surrounding the shielding braid; and wherein the shell comprises a rear shell comprising a main portion surrounding a rear end of the front shell, a transitional portion extending rearwardly from the main portion, and a cylindrical portion extending rearwardly from the transitional portion and enclosing the shielding of the cable.

3. The cable connector assembly as claimed in claim 2, wherein the main portion of the rear shell defines a pair of openings therein, and wherein the front shell comprises a pair of latches received in the openings of the rear shell.

* * * * *